US010178917B2

(12) United States Patent
Thoutam et al.

(10) Patent No.: US 10,178,917 B2
(45) Date of Patent: Jan. 15, 2019

(54) REFRIGERATED DISPLAY CASES WITH THERMAL-BLOCK DOORFRAMES

(71) Applicant: Heatcraft Refrigeration Products LLC, Richardson, TX (US)

(72) Inventors: Saikiran Thoutam, Columbus, GA (US); Rahul Gokhale, Dunwoody, GA (US); Santosh Nerur, Suwanee, GA (US); Ajay Chidambaram Pillai Swornalatha, Kanyakumari (IN); Vinod Kunchala, Chennai (IN); Revanth Muppala, Chennai (IN)

(73) Assignee: Heatcraft Refrigeration Products LLC, Richardson, TX (US)

( * ) Notice: Subject to any disclaimer, the term of this patent is extended or adjusted under 35 U.S.C. 154(b) by 206 days.

(21) Appl. No.: 15/264,553

(22) Filed: Sep. 13, 2016

(65) Prior Publication Data

US 2018/0070744 A1 Mar. 15, 2018

(51) Int. Cl.
*A47F 3/04* (2006.01)
*E06B 1/32* (2006.01)

(52) U.S. Cl.
CPC ..... *A47F 3/043* (2013.01); *E06B 1/32* (2013.01)

(58) Field of Classification Search
CPC ..... A47F 3/043; A47F 3/04; A47F 3/0404; A47F 3/04; A47F 3/0426; A47F 3/0434
See application file for complete search history.

(56) References Cited

U.S. PATENT DOCUMENTS 4,004,370 A * 1/1977 Heaney ..... A47F 3/043 49/504
4,367,632 A * 1/1983 Ibrahim ..... A47F 3/0408 62/256
4,369,631 A * 1/1983 Abraham ..... F25D 21/125 62/255
4,369,632 A * 1/1983 Abraham ..... A47F 3/0408 62/256
2009/0045712 A1* 2/2009 Laible ..... A47B 96/20 312/401
2011/0304253 A1* 12/2011 Howington ..... F25D 21/04 312/405
2014/0260360 A1* 9/2014 Rasch ..... A47F 3/0478 62/80
2015/0285551 A1* 10/2015 Aiken ..... F25D 21/006 62/80
2018/0055247 A1* 3/2018 Chikkakalbalu ..... A47F 3/0408

* cited by examiner

*Primary Examiner* — Daniel J Rohrhoff
(74) *Attorney, Agent, or Firm* — Hubbard Johnston, PLLC

(57) ABSTRACT

In a refrigerated display case having an interior volume that is accessed through a door panel being opened from a doorframe, a frame cover is included that may reduce condensation or the power required to avoid condensation on a door panel. The frame cover is formed of a non-metallic material that provides a thermal break. The frame cover may also be formed with air pockets to further enhance the thermal break. Moreover, it may be formed to attach with an interference fit and thereby avoid fasteners. Other embodiments and features are presented.

20 Claims, 4 Drawing Sheets

REFRIGERATED DISPLAY CASES WITH THERMAL-BLOCK DOORFRAMES

TECHNICAL FIELD

This application is directed to refrigerated display cases and, more particularly, to refrigerated display cases with thermal-block doorframes and methods of manufacturing the same.

BACKGROUND

Modern supermarkets and other outlets often use refrigerated display cases to store and display different types of frozen and refrigerated products. The refrigerated display cases allow consumers to open one or more doors to access a refrigerated space where the products are displayed.

One of the issues with refrigerated display cases at times is condensation—"sweating"—on the doorframe and glass. To address this issue, the doorframe often needs to be maintained at a temperature greater than some specified temperature, e.g., 58 degrees Fahrenheit. This in turn may require heating elements to supply considerable amounts of power.

SUMMARY

According to one illustrative embodiment of the present disclosure a refrigerated display case for refrigerating and displaying products includes a base member, a back wall coupled to the base member, a top member coupled to the back wall, a plurality of side members coupled to the top member, and a front wall coupled to the side members and having at least one door member. The base member, back member, side members, and front wall form an interior volume. The base member comprises one or more tub assemblies. The refrigerated display case further includes a refrigeration unit associated with the one or more tub assemblies for supplying refrigerated air into the interior volume to refrigerate the products.

The one or more tub assemblies include a front tub arm extending to a substantially vertical portion. The door member includes a doorframe forming a perimeter with an door-frame interior portion, a door panel sized and configured to fit substantially within the door-frame interior portion and coupled to the doorframe at least in part by one or more hinges, and the doorframe having a bottom member that is coupled to the front tub arm. The refrigerated display case also includes a frame cover formed from a non-metallic material and coupled to the bottom member of the doorframe to form a thermal break between the bottom member of the doorframe and the interior volume.

According to an illustrative embodiment, a method of manufacturing a refrigerated display case for refrigerating and displaying products includes providing a base member, coupling a back wall to the base member, coupling a top member to the back wall, coupling a plurality of side members to the top member, and coupling a front wall to the side members, wherein the front wall includes at least one door member. The base member, back member, side members, and front wall form an interior volume. The base member includes one or more tub assemblies.

The method further includes associating a refrigeration unit with the one or more tub assemblies for supplying refrigerated air into the interior volume to refrigerate the products. The door member includes a doorframe forming a perimeter with an door-frame interior portion, a door panel sized and configured to fit substantially within the doorframe interior portion and coupled to the doorframe at least in part by one or more hinges, and the doorframe having a bottom member that is coupled to the front tub arm. The method also includes forming a frame cover from a non-metallic material and coupling the frame cover to the bottom member of the doorframe to form a thermal break between the bottom member of the doorframe and the interior volume. Other illustrative embodiments are included herein.

BRIEF DESCRIPTION

Reference is now made to the following descriptions taken in conjunction with the accompanying drawings, in which.

DETAILED DESCRIPTION

Figure 1:
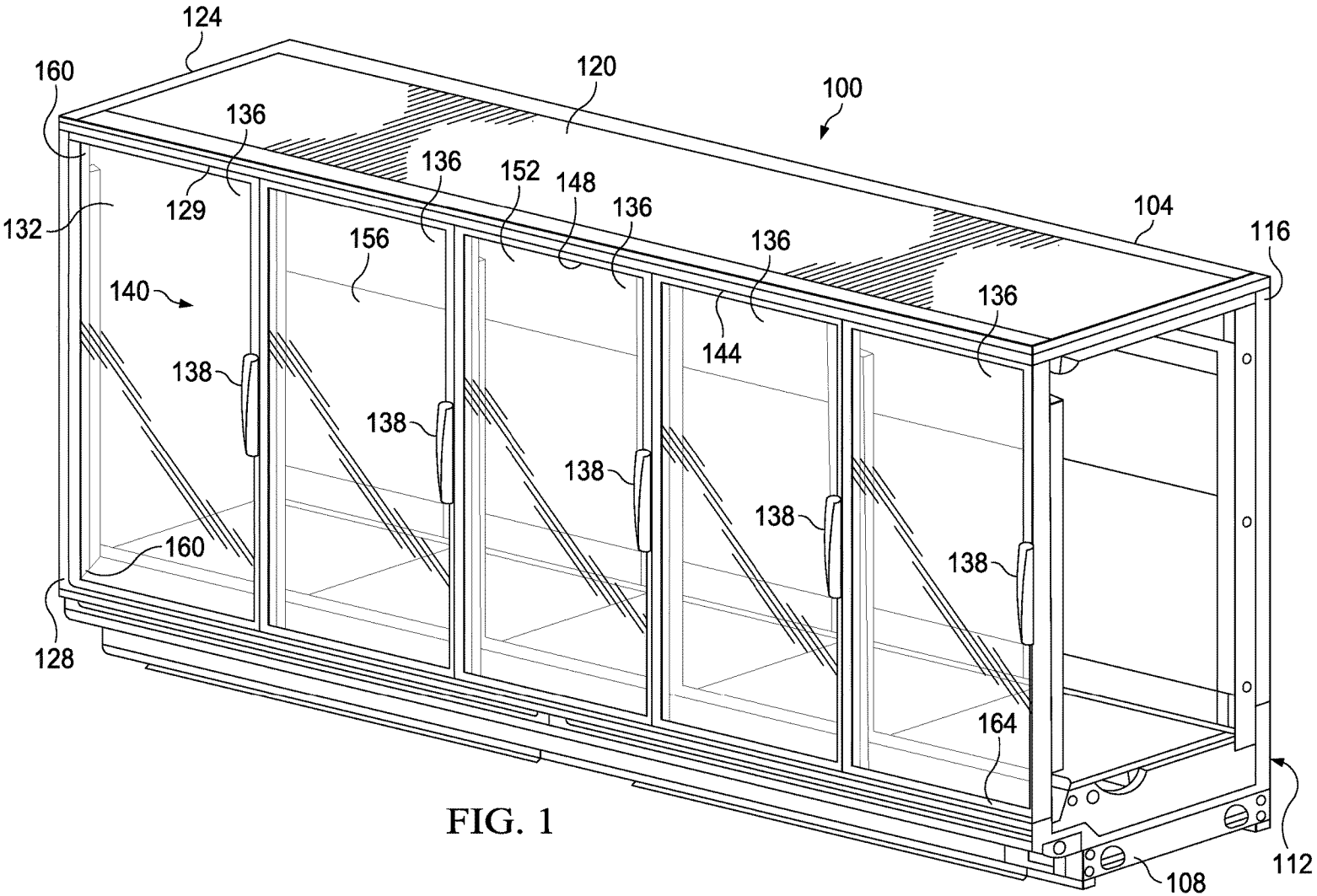
FIG. 1 is a schematic perspective view of an illustrative embodiment of a refrigerated display case according to an aspect of the present disclosure.

Referring now to the figures, and initially and primarily to FIG. 1, a refrigerated display case 100 is presented in the form of a reach-in cooler 104. The refrigerated display case 100 includes a base member 108, which may be or include a tub assembly 112. The tub assembly 112 may include one or more refrigeration units (e.g., refrigeration unit 173 in FIG. 4) for preparing refrigerated air. The base member 108 is coupled to a back wall 116. A top member 120 is coupled to the back wall 116. A plurality of side members 124 is coupled to the top member 120. A front wall 128, which includes a door frame 129, is coupled to the side members 124. The front wall 128 includes at least one door member 132 and usually a plurality of door members 136, each having a handle 138. The base member 108, back wall 116, top member 120, side members 124, and front wall 128 form an interior volume 140. The interior volume 140 comprises a refrigerated space for displaying and refrigerating products. The products typically rest on a plurality of shelves that are not explicitly shown.

The door member 132, or each of the plurality of door members 136, includes a doorframe 144 that forms a perimeter 148 with a door-frame interior portion 152. A door panel 156, which may be transparent, is sized and configured to fit substantially within the doorframe interior portion 152. In some embodiments, the door panel 156 may extend beyond a portion of the doorframe interior portion 152. The door panel 156 is rotatably coupled to the doorframe 144 at least in part by one or more hinges 160. The doorframe 144 includes a bottom member 164 that is coupled to a portion of the tub assembly 112. As an important aspect of the present disclosure, a frame cover (168 in FIG. 2) is used to provide a thermal break between the bottom member 164 of the doorframe 144 and the interior volume 140 as will now be explained in further detail.

Figure 2:
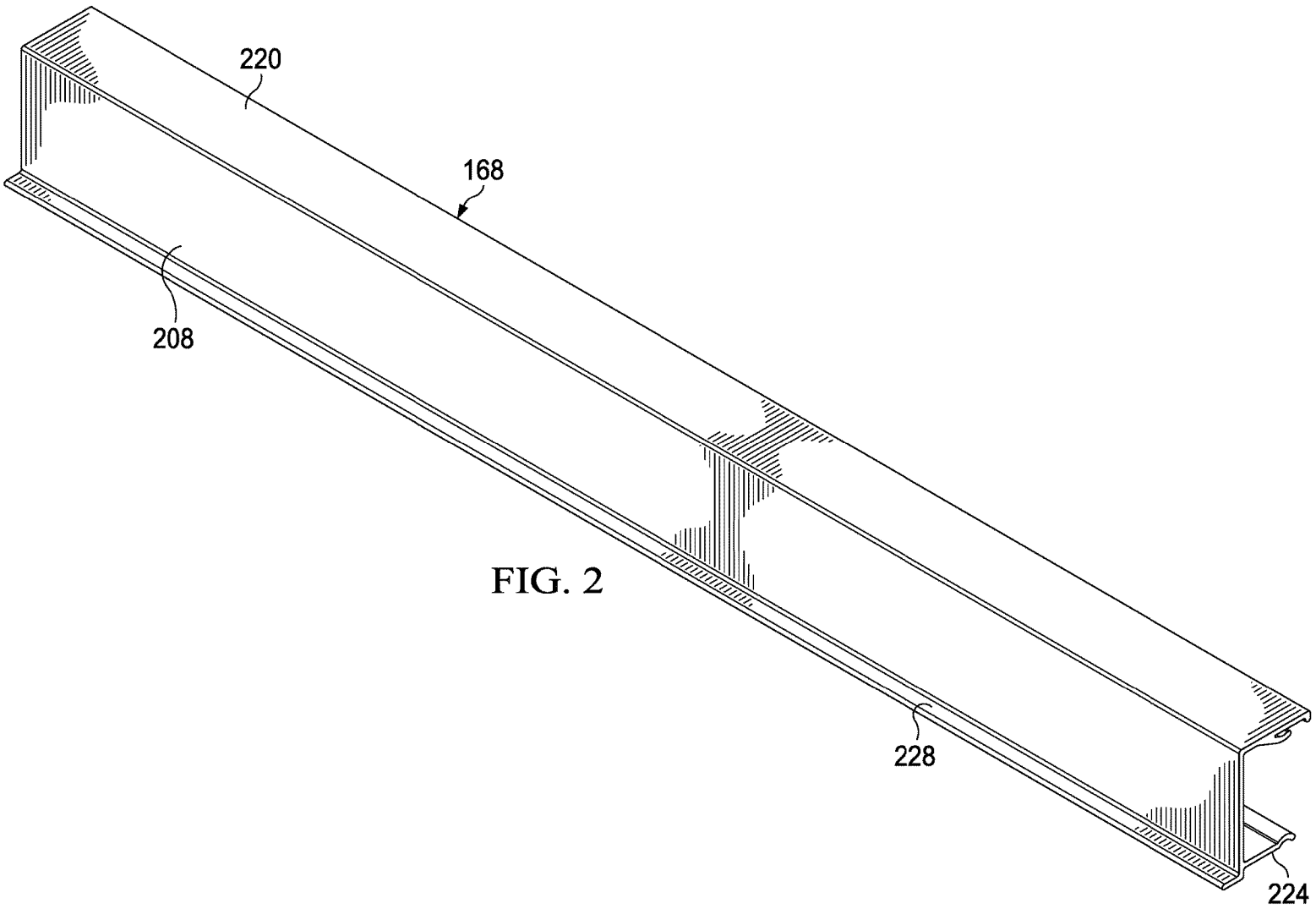
FIG. 2 is a schematic perspective view of an illustrative embodiment of a frame cover.
Figure 3:
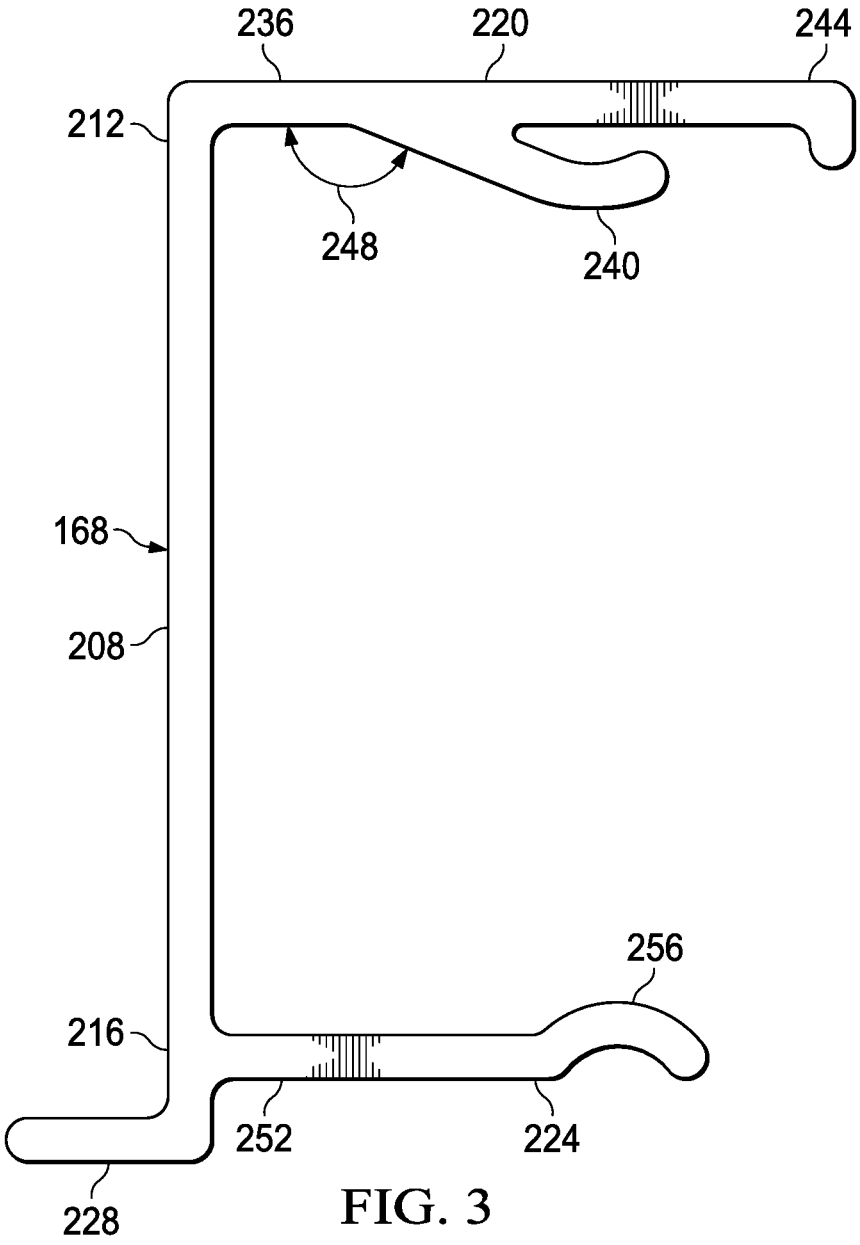
FIG. 3 is an end view of the frame cover of FIG. 2.
Figure 4:
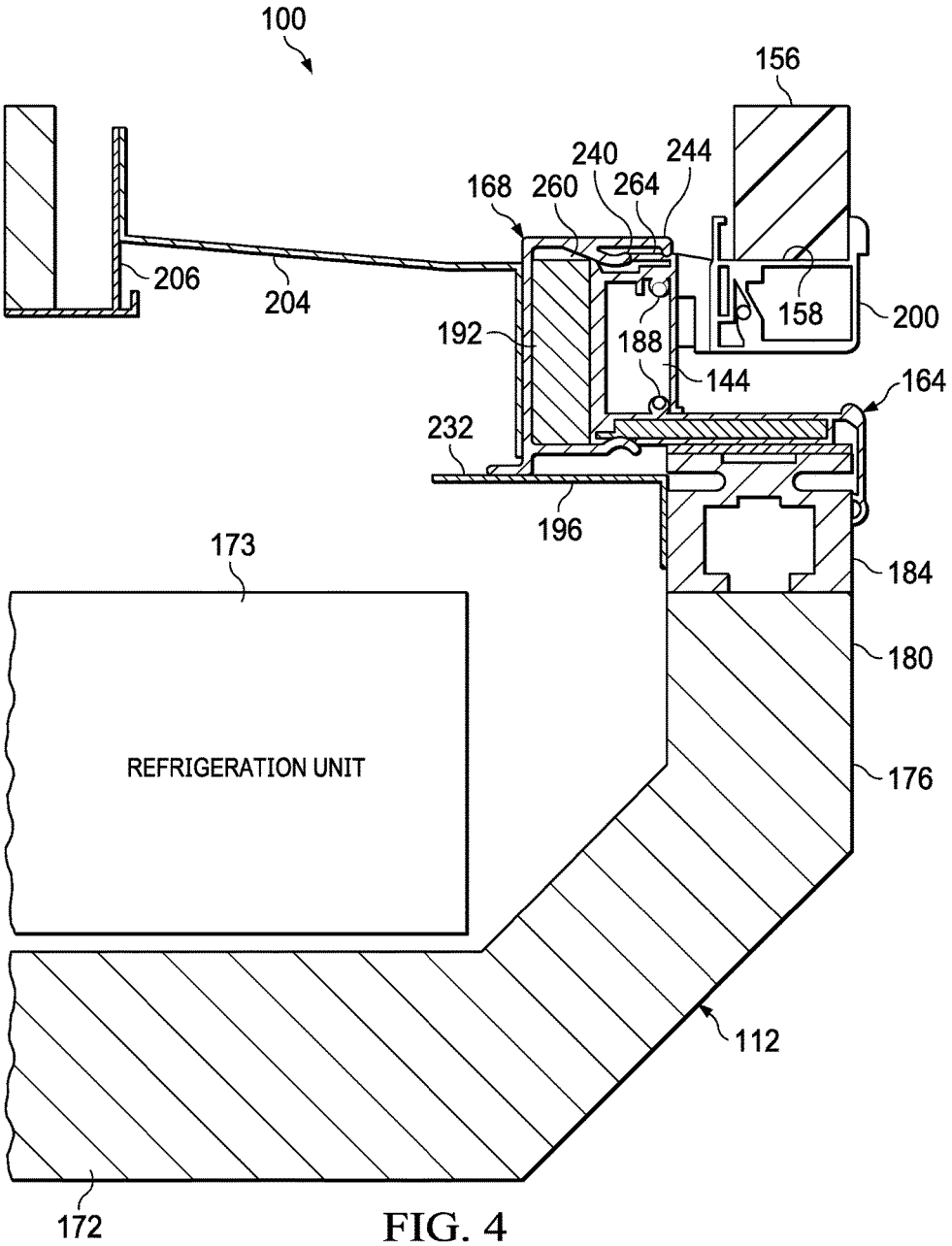
FIG. 4 is a schematic cross-section of a portion of a refrigerated display case showing a frame cover in an assembled position.

Referring now to FIGS. 2-4, an illustrative embodiment of the frame cover 168 for use as an aspect of the refrigerated display case 100 is presented. Referring initially to FIG. 4, the frame cover 168 is shown in an assembled position as an aspect of the refrigerated display case 100. A portion of the tub assembly 112 is shown with a tub 172 shown with a front tub arm 176 extending to a substantially vertical portion 180. An assembly member 184 is coupled to the front tub arm 176 on an end of the substantially vertical portion 180. As shown in FIG. 4, the doorframe 144 may be coupled to the assembly member 184. The doorframe 144 may include one or more heating elements 188, or "hot wires." An insulation member 192 may be coupled, e.g., by glue, to an inside surface of the vertical arm 208 of the frame cover 168.

A portion of the frame cover 168 may rest upon or make contact with an attachment member 196, which in this embodiment is an "L" shaped bracket. In this view, the door panel 156 is shown to have at a bottom edge 158 on a sealing assembly 200, which has a portion that rests against the doorframe 144 when the door panel 156 is in a closed position as shown. An air return grill 204 is visible in FIG. 4. The air return grill 204 may rest on a support member, e.g., sheet metal component 206.

Referring now primarily to FIGS. 2 and 3, more details will be provided for one illustrative embodiment of the frame cover 168. The frame cover 168 is formed from a non-metallic material, such as polyvinylchloride (PVC). The frame cover 168 is coupled to the bottom member 164 of the doorframe 144 (See FIGS. 1 and 4).

As shown most clearly in FIG. 3, the frame cover 168 may include a first vertical arm 208 having a first end 212 and a second end 216. Words of orientation, e.g., vertical, are with respect to the assembled position shown in FIG. 4. The frame cover 168 also includes a first horizontal arm 220 coupled to the vertical arm 208 proximate the first end 212 and extending toward the door member 132 when in the assembled position. The frame cover 168 also includes a second horizontal arm 224 coupled to the vertical arm 208 proximate the second end 216 and extending toward the door member 132 when in the assembled position. The frame cover 168 may also include a third horizontal arm 228 coupled to the vertical arm 208 proximate the second end 216 and extending away from the door member 132 when in the assembled position. The first horizontal arm 220 and the second horizontal arm 224 are spaced from one another and configured so as to form an interference fit with a portion of the doorframe 144 when in an assembled position. In some embodiments, the interference fit is adequate to completely attach the frame cover 168 without requiring any fasteners.

Referring now primarily to FIGS. 3 and 4, the third horizontal arm 228 may be supported by a planar portion 232 of the attachment member 196, which may be coupled to the front tub arm 176 directly or by way of the assembly member 184.

Referring again to primarily FIG. 3, the first horizontal arm 220 of the frame cover 168 includes a base portion 236, an inwardly-projecting interference member 240, and a distal portion 244, or distal member. An angle 248 is formed going from the base portion 236 to an inward surface of the inwardly-projecting interference member 240. The angle 248 is typically greater than 140 degrees and may be, for example, without limitation, 158 degrees. The second horizontal arm 224 of the frame cover 168 includes a base portion 252 and an inwardly-projecting distal portion 256, which may provide additional flexing and griping for an interference fit. The inwardly-projecting distal portion 256 may be a curved member as shown or may take another shape as those skilled in the art will appreciate.

The non-metallic nature of the frame cover 168 helps to provide a thermal break with the metallic door member 132 and, in particular, with the doorframe 144. Because of the thermal break, heat delivered by the heating elements 188 does not dissipate by convection into the interior volume but is conducted towards a location external to the interior volume thereby reducing condensation. To further enhance the thermal break, various air pockets may be intentionally formed as an aspect of the frame cover 168 when the assembled position. Thus, referring again to FIG. 4, a first air pocket 260 is formed between the first horizontal arm 220 of the frame cover 168 and a portion of the case frame 192. As another example, a second air pocket 264 may be formed between the distal portion 244 of the first horizontal arm 220 of the frame cover 168 and the inwardly-projecting interference member 240.

According to one illustrative embodiment of the present disclosure, a refrigerated display case for refrigerating and displaying products includes a base member, a back wall coupled to the base member, a top member coupled to the back wall, a plurality of side members coupled to the top member, back member, and base member. The display further includes a front wall coupled to the side members, base member, and top member. The front wall has at least one door member. The base member, back member, side members, and front wall form an interior volume. The base member comprises one or more tub assemblies. The refrigerated display case further includes a refrigeration unit associated—coupled, disposed on, etc.—with the one or more tub assemblies for supplying refrigerated air into the interior volume to refrigerate the products.

The one or more tub assemblies may include a front tub arm extending to a substantially vertical portion. The door member includes a doorframe forming a perimeter with an door-frame interior portion, a door panel sized and configured to fit substantially within the door-frame interior portion (this may include some overlap as shown in FIG. 4) and coupled to the doorframe at least in part by one or more hinges. The doorframe has a bottom member that is coupled to the front tub arm. The refrigerated display case also includes a frame cover formed a non-metallic material and coupled to the bottom member of the doorframe to form a thermal break between the bottom member of the doorframe and the interior volume. The thermal break of the frame cover allows the door frame to stay warmer than it otherwise would since heat does not migrate into the interior volume. This may allow for less condensation for a given power setting to the hot wires or may allow the power to the hot wires to be reduced.

According to an illustrative embodiment, a method of manufacturing a refrigerated display case for refrigerating and displaying products includes providing a base member, coupling a back wall to the base member, coupling a top member to the back wall, coupling a plurality of side members to the top member, and coupling a front wall to the side members. Other members may all be coupled one to another to form a substantially airtight interior volume. The front wall includes at least one door member. The base member, back member, side members, and front wall form the interior volume. The base member includes one or more tub assemblies.

The method further includes associating—coupling physically or fluidly or setting on it—a refrigeration unit with the one or more tub assemblies for supplying refrigerated air into the interior volume to refrigerate the products. The door member includes a doorframe forming a perimeter with an door-frame interior portion, a door panel sized and configured to fit substantially within the door-frame interior portion and coupled to the doorframe at least in part by one or more hinges. The doorframe has a bottom member that may be coupled to the front tub arm. The method also includes forming a frame cover from a non-metallic material and coupling the frame cover to the bottom member of the doorframe to form a thermal break between the bottom member of the doorframe and the interior volume. As previously mentioned, this provides less condensation on the door or better efficiency in terms of the power to the hot wires.

As used herein, the term "coupled" includes coupling via a separate object and includes direct coupling. The term "coupled" also encompasses two or more components that are continuous with one another by virtue of each of the components being formed from the same piece of material or associated one to another by a magnetic field.

The present invention and its advantages have been disclosed in the context of certain illustrative, non-limiting embodiments. The illustrative descriptions above are not intended to be exhaustive or to limit the invention to the precise forms disclosed. Moreover, it should be understood that various changes, substitutions, permutations, and alterations can be made without departing from the scope of the invention as defined by the appended claims. It will be appreciated that any feature that is described in connection to any one embodiment may also be applicable to any other embodiment.

What is claimed is:

1. A refrigerated display case for refrigerating and displaying products, the refrigeration display case comprising:
- a base member;
- a back wall coupled to the base member;
- a top member coupled to the back wall;
- a plurality of side members coupled to the top member;
- a front wall coupled to the side members and having at least one door member;
- the base member, the back wall, the plurality of side members, and the front wall form an interior volume;
- wherein the base member comprises one or more tub assemblies;
- a refrigeration unit associated with the one or more tub assemblies for supplying refrigerated air into the interior volume to refrigerate the products;
- wherein the one or more tub assemblies includes a front tub arm extending to a substantially vertical portion;
- wherein the door member comprises:
- a doorframe forming a perimeter with a door-frame interior portion,
- a door panel sized and configured to fit substantially within the door-frame interior portion and coupled to the doorframe at least in part by one or more hinges, and
- the doorframe having a bottom member that is coupled to the front tub arm; and
- a frame cover formed from a non-metallic material and coupled to the bottom member of the doorframe and extending toward the interior volume to form a thermal break between the bottom member of the doorframe and the interior volume.

2. The refrigerated display case of claim 1, wherein the frame cover comprises polyvinyl chloride.

3. The refrigerated display case of claim 1, wherein the frame cover comprises:
- a first vertical arm having a first end and a second end;
- a first horizontal arm coupled to the vertical arm proximate the first end and extending toward the door member when in an assembled position;
- a second horizontal arm coupled to the vertical arm proximate the second end and extending toward the door member when in an assembled position;
- a third horizontal arm coupled to the vertical arm proximate the second end and extending away from the door member when in an assembled position; and
- wherein the first horizontal arm and the second horizontal arm are displaced from one another and sized and configured to form an interference fit with a portion of the doorframe when in an assembled position.

4. The refrigerated display case of claim 3, further comprising a attachment member coupled to the front tub arm and having a planar portion extending away from the door member when in an assembled position, and wherein the third horizontal arm of the frame cover is disposed against the planar portion when in an assembled position.

5. The refrigerated display case of claim 3, wherein the first horizontal arm of the frame cover comprises a base portion, a inwardly-projecting interference member, and a distal portion.

6. The refrigerated display case of claim 5, wherein the inwardly-projecting interference member and base portion of the first horizontal arm form an angle greater than 140 degrees.

7. The refrigerated display case of claim 5, wherein the first horizontal arm and a portion of a case frame form a first air pocket.

8. The refrigerated display case of claim 5, wherein the first horizontal arm and a portion of a case frame form a first air pocket, and wherein the distal portion of the first horizontal arm and the inwardly-projecting interference member form a second air pocket.

9. The refrigerated display case of claim 3, wherein the second horizontal arm has a base portion and an inwardly-projecting distal portion.

10. The refrigerated display case of claim 1, wherein the frame cover comprises:
- a first vertical arm having a first end and a second end;
- a first horizontal arm coupled to the vertical arm proximate the first end and extending toward the door member when in an assembled position;
- a second horizontal arm coupled to the vertical arm proximate the second end and extending toward the door member when in an assembled position;
- a third horizontal arm coupled to the vertical arm proximate the second end and extending away from the door member when in an assembled position;
- wherein the first horizontal arm and the second horizontal arm are displaced from one another and sized and configured to form an interference fit with a portion of the doorframe when in an assembled position;
- wherein the first horizontal arm of the frame cover comprises a base portion, a inwardly-projecting interference member, and a distal portion;
- wherein the inwardly-projecting interference member and base portion of the first horizontal arm form an angle greater than 140 degrees;
- wherein the second horizontal arm has a base portion and an inwardly-projecting distal portion; and
- wherein the first horizontal arm and a portion of a display frame form a first air pocket.

11. A method of manufacturing a refrigerated display case for refrigerating and displaying products, the method comprising
- providing a base member;
- coupling a back wall to the base member;
- coupling a top member to the back wall;
- coupling a plurality of side members to the top member;
- coupling a front wall to the side members, wherein the front wall includes at least one door member;

whereby the base member, the back wall, the plurality of side members, and the front wall form an interior volume;

wherein the base member comprises one or more tub assemblies;

associating a refrigeration unit with the one or more tub assemblies for supplying refrigerated air into the interior volume to refrigerate the products;

wherein the door member comprises:

a doorframe forming a perimeter with an door-frame interior portion, a door panel sized and configured to fit substantially within the door-frame interior portion and coupled to the doorframe at least in part by one or more hinges, and the doorframe having a bottom member that is coupled to the front tub arm;

forming a frame cover from a non-metallic material; and coupling the frame cover to the bottom member of the doorframe to form a thermal break between the bottom member of the doorframe and the interior volume.

12. The method of claim 11, wherein the step of forming a frame cover from a non-metallic material comprises forming a frame cover from polyvinyl chloride.

13. The method of claim 11, wherein the frame cover comprises:

a first vertical arm having a first end and a second end;

a first horizontal arm coupled to the vertical arm proximate the first end and extending toward the door member when in an assembled position;

a second horizontal arm coupled to the vertical arm proximate the second end and extending toward the door member when in an assembled position;

a third horizontal arm coupled to the vertical arm proximate the second end and extending away from the door member when in an assembled position; and wherein the first horizontal arm and the second horizontal arm are sized and configured to form an interference fit with a portion of the doorframe when in an assembled position.

14. The method of claim 13, further comprising coupling an attachment member to the tub assembly and having a planar portion extending away from the door member when in an assembled position, and wherein the third horizontal arm of the frame cover is disposed against the planar portion when in an assembled position.

15. The method of claim 13, wherein the first horizontal arm of the frame cover comprises a base portion, a inwardly-projecting interference member, and a distal portion.

16. The method of claim 15, wherein the inwardly-projecting interference member and base portion of the first horizontal arm forms an angle greater than 140 degrees.

17. The method of claim 13, wherein the second horizontal arm has a base portion and an inwardly-projecting distal portion.

18. The method of claim 13, further comprising forming a first air pocket between the first horizontal arm and a portion of a display frame.

19. The method of claim 13, further comprising forming a second air pocket between the distal portion of the first horizontal arm and the inwardly-projecting interference member.

20. The method of claim 11, wherein the step of coupling the frame cover to the bottom member of the doorframe to form a thermal break between the bottom member of the doorframe and the interior volume comprises coupling the frame cover using only interference fit.

* * * * *